US005374238A

United States Patent [19]

Xiao

[11] Patent Number: 5,374,238

[45] Date of Patent: Dec. 20, 1994

[54] VIBRATING NECK REST FOR THE PASSENGER SEAT OF A MOTOR VEHICLE

[76] Inventor: Ji Xiao, 2616 Van Paten St., Apt. 10, Las Vegas, Nev. 89109

[21] Appl. No.: 92,956

[22] Filed: Jul. 19, 1993

[51] Int. Cl.[5] ..... A61H 1/00

[52] U.S. Cl. ..... 601/57; 601/56; 601/46; 601/49

[58] Field of Search ..... 601/46, 48, 49-54, 601/56-60, 61, 67-70, 78, 80, 81

[56] References Cited

U.S. PATENT DOCUMENTS

| | | | |
|---|---|---|---|
| D. 247,312 | 2/1978 | Zeiss | D24/64 |
| 2,675,800 | 10/1952 | Voorhees | 128/36 |
| 2,687,718 | 8/1954 | Britton et al. . | |
| 2,943,621 | 8/1958 | Phillips | 128/41 |
| 3,613,617 | 10/1971 | Poor . | |
| 4,878,489 | 11/1989 | Kamayachi | 128/36 |
| 4,935,972 | 6/1990 | Brady | 128/33 |
| 4,989,584 | 2/1991 | Simon | 128/36 |
| 5,099,829 | 3/1992 | Wu | 128/36 |

*Primary Examiner*—Max Hindenburg

*Assistant Examiner*—David J. Kenealy

*Attorney, Agent, or Firm*—Rhodes & Ascolillo

[57] ABSTRACT

A vibrating neck rest particularly adapted for attachment to and use in conjunction with a passenger seat a motor vehicle, the vibrating neck rest including a cushion, the cushion being substantially elongated and having a major longitudinal axis, a vibration unit disposed within the cushion for producing a vibration on at least a portion of a surface of the cushion, a pair of tubes, one each of the pair of tubes extending outward from an opposing side of the vibration unit, the pair of tubes extending outward from the vibration unit substantially parallel to the major longitudinal axis of the cushion, a pair of hammer members, one each of the hammer members being attached to a distal end of one each of the tubes, an attachment apparatus for attaching the cushion to the passenger seat of the motor vehicle, and a control mechanism for altering at least one characteristic of the vibration produced by the vibrating apparatus, the control mechanism being movable to a point remote from the cushion.

4 Claims, 3 Drawing Sheets

VIBRATING NECK REST FOR THE PASSENGER SEAT OF A MOTOR VEHICLE

BACKGROUND

1. Field of the Invention

The present invention relates to the field of neck rests, most particularly neck rests adapted for use in conjunction with a passenger seat of a motor vehicle.

2. Description of the Related Art

U.S. Pat. No. 4,935,972 relates to an impermeable vibrating pillow provided with suction cups, so that it may be conveniently bonded temporarily to the surface of a bathtub or the like.

U.S. Pat. No. 3,613,671 relates to a seat and headrest having a plurality of inflatable air chambers which are alternately inflated and deflated to produce a massaging effect.

U.S. Pat. No. 2,687,718 relates to an apparatus for producing pulsations having a motor driven shaft actuating weights disposed in bores transversely to the shaft.

Finally, U.S. Pat. Des. No. 247,312 relates to an ornamental design for a head rest for a back massaging cushion.

SUMMARY OF THE INVENTION

In one aspect, the invention generally features a vibrating neck rest particularly adapted for attachment to and use in conjunction with a passenger seat of a motor vehicle, the vibrating neck rest comprising: a cushion; a vibrating apparatus disposed within the cushion for producing a vibration on at least a portion of a surface of the cushion; an attachment apparatus for attaching the cushion to the passenger seat of the motor vehicle; and a control mechanism for altering at least one characteristic of the vibration produced by the vibrating apparatus; the control mechanism being movable to a point remote from the cushion.

Preferably, the vibrating apparatus includes: a vibration unit: a pair of tubes, one each of the pair of tubes extending outward from an opposing side of the vibration unit; and a pair of hammer members, one each of the hammer members being attached to a distal end of one each of the pair of tubes; the cushion is substantially elongated and has a major longitudinal axis, and the pair of tubes extend outward from the vibration unit substantially parallel to the major longitudinal axis of the cushion; the cushion has a front surface for contacting the neck of a user, and the vibrating neck rest additionally includes a shield apparatus extending over at least a portion of the front surface of the cushion, the shield apparatus overlaying at least the vibration unit; the shield apparatus additionally overlays the pair of tubes; the shield apparatus includes a first shield member and a distinct and separate second shield member, the first shield member being disposed intermediate between the vibration unit and the second shield member; each of the pair of hammer members is annular shaped, and one each of the pair of hammer members is disposed within one each of the distal ends of the pair of tubes; the first shield member is provided with a pair of inwardly turned ends, one each of the inwardly turned ends projecting into one each of the annular shaped hammer members; each of the tubes is provided with annular corrugations on at least a portion of its external surface; the control mechanism includes battery powered control circuitry; and the characteristic of the vibration altered by the control mechanism includes a speed of vibration.

In another aspect, the invention generally features a vibrating neck rest particularly adapted for attachment to and use in conjunction with a passenger seat a motor vehicle, the vibrating neck rest including: a cushion; the cushion being substantially elongated and having a major longitudinal axis; a vibration unit disposed within the cushion for producing a vibration on at least a portion of a surface of the cushion; a pair of tubes, one each of the pair of tubes extending outward from an opposing side of the vibration unit; the pair of tubes extending outward from the vibration unit substantially parallel to the major longitudinal axis of the cushion; a pair of hammer members, one each of the hammer members being attached to a distal end of one each of the tubes; an attachment apparatus for attaching the cushion to the passenger seat of the motor vehicle; and a control mechanism for altering at least one characteristic of the vibration produced by the vibrating apparatus; the control mechanism being movable to a point remote from the cushion.

Preferably, the attachment means includes a pair of strap members, one each of the pair of strap members extending from an end face of the cushion, each of the pair of strap members extending substantially parallel to the major longitudinal axis of the cushion, a hook attachment device secured to one of the pair of strap members, and a loop attachment device secured to the other of the strap members.

In a still further aspect, the invention features a vibrating neck rest particularly adapted for attachment to and use in conjunction with a passenger seat of a motor vehicle, the vibrating neck rest including: a cushion; the cushion being substantially elongated and having a major longitudinal axis; the cushion having a front surface for contacting the neck of a user; a vibration unit disposed within the cushion for producing a vibration on at least the front surface of the cushion; a pair of tubes, one each of the pair of tubes extending outward from an opposing side of the vibration unit; each of the tubes being provided with annular corrugations on at least a portion of its external surface; the pair of tubes extending outward from the vibration unit substantially parallel to the major longitudinal axis of the cushion; a pair of hammer members; each of the pair of hammer members being annular shaped, and one each of the pair of hammer members being disposed within one each of a distal end of the pair of tubes; a shield apparatus extending over at least a portion of the front surface of the cushion, the shield apparatus overlaying the vibration unit, the pair of tubes, and the pair of annular hammer members; the shield apparatus including a first shield member and a distinct and separate second shield member, the first shield member being disposed intermediate between the vibration unit and the second shield member; the first shield member being provided with a pair of inwardly turned ends, one each of the inwardly turned ends projecting into one each of the annular shaped hammer members; an attachment apparatus for attaching the cushion to the passenger seat of the motor vehicle; and a control mechanism for altering at least one characteristic of the vibration produced by the vibration unit; the control mechanism being movable to a point remote from the cushion; the control mechanism including battery powered control circuitry; and the characteristic of the vibration altered by the control mechanism including a speed of vibration.

One object of the present invention is the provision of a vibrating head rest particularly adapted for mounting on and use in conjunction with the passenger seat of a motor vehicle.

Another object of the invention is the provision of such a head rest wherein the speed of vibration is conveniently adjustable by the user thereof.

Yet another object of the present invention is the provision of such a head rest that is portable in that it can easily be moved from one passenger seat to another.

A still further object of the invention is the provision of a vibrating head rest for a passenger seat of a motor vehicle that is reliable in operation and inexpensive to manufacture.

The invention will now be described by way of a particularly preferred embodiment, reference being made to the accompanying drawings, wherein:

DESCRIPTION OF THE PREFERRED EMBODIMENT

Figure 1:
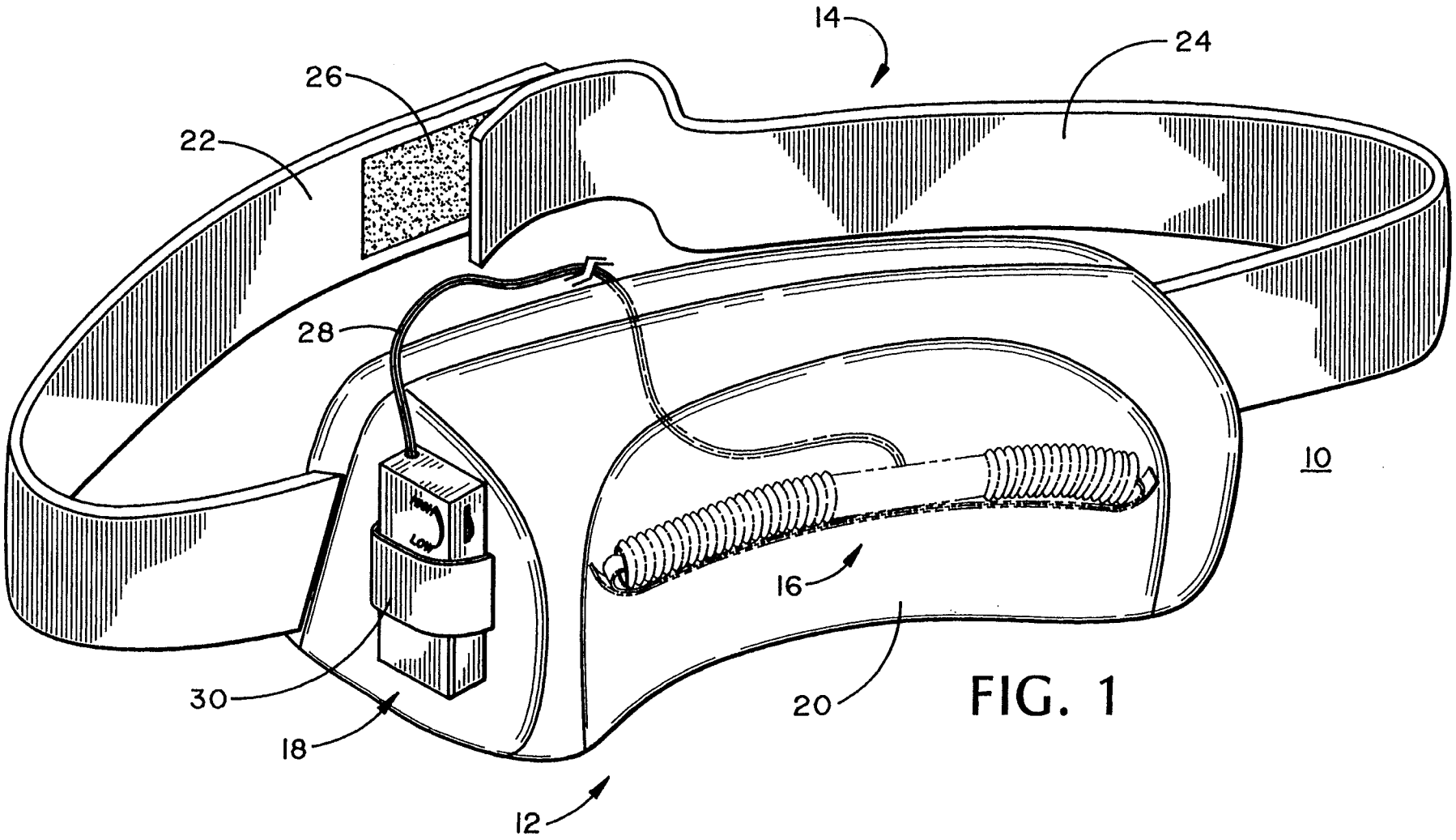
FIG. 1 is a perspective view of a vibrating neck rest for the passenger seat of a motor vehicle, constructed according to the present invention.

Referring initially most particularly to FIG. 1, a vibrating neck rest 10, particularly adapted for use in conjunction with the passenger seat of a motor vehicle and constructed according to the present invention, generally includes a cushion 12, a strap 14 for attaching the cushion 12 to the passenger seat of the motor vehicle, a vibrating mechanism 16 disposed within the interior of the cushion 12 for producing a vibrating action on at least a portion of the surface of the cushion 12, and a control module 18 for controlling at least one characteristic of the vibration produced by the vibrating mechanism 16. Preferably, the control module 18 is of a type well understood in the art and includes circuitry for activating and deactivating the vibrating mechanism 16, as well as for controlling the speed and/or intensity of the vibrations produced thereby.

As shown in FIG. 1, the cushion 12 is of generally oblong shape and has an arcuate forward surface 20 designed to accommodate the neck and lower cranial region of a user thereof. Additionally, the vibrating mechanism 16 itself is of generally elongated configuration and extends parallel to the major longitudinal axis of the cushion 12. The strap 14 preferably includes two strap portions 22 and 24, one each of which extends outward from the opposing end faces of the generally oblong shaped cushion 12, the ends of the two strap portions 22 and 24 each being provided with one component of a hook and loop fastener 26. Preferably, the hook and loop fastener 26 is of, or similar to, the type of hook and loop fasteners commercially available under the trademark "VELCRO". The strap portions 22 and 24 and the hook and loop fastener 26 permit easy and adjustable attachment of the neck rest 10 to the passenger seat of the motor vehicle, and also allow the neck rest 10 to be easily transferred from one passenger seat to another.

The control module 18 is preferably electrically connected to the vibrating mechanism 16 via a substantial length of electrical cord 28 and is therefore movable to a point remote from the cushion 12, thus allowing the control module 18 to be placed where it can be conveniently operated by a user. Additionally, as is also seen most clearly in FIG. 1, a loop of material 30 (e.g., fabric) is preferably secured to one of the end faces of the cushion 12, thereby allowing the control module 18 to be secured to the exterior surface of the cushion 12 for storage, during movement of the neck rest 10 from one passenger seat to another, or to prevent misplacement of the control module 18.

Figure 2:
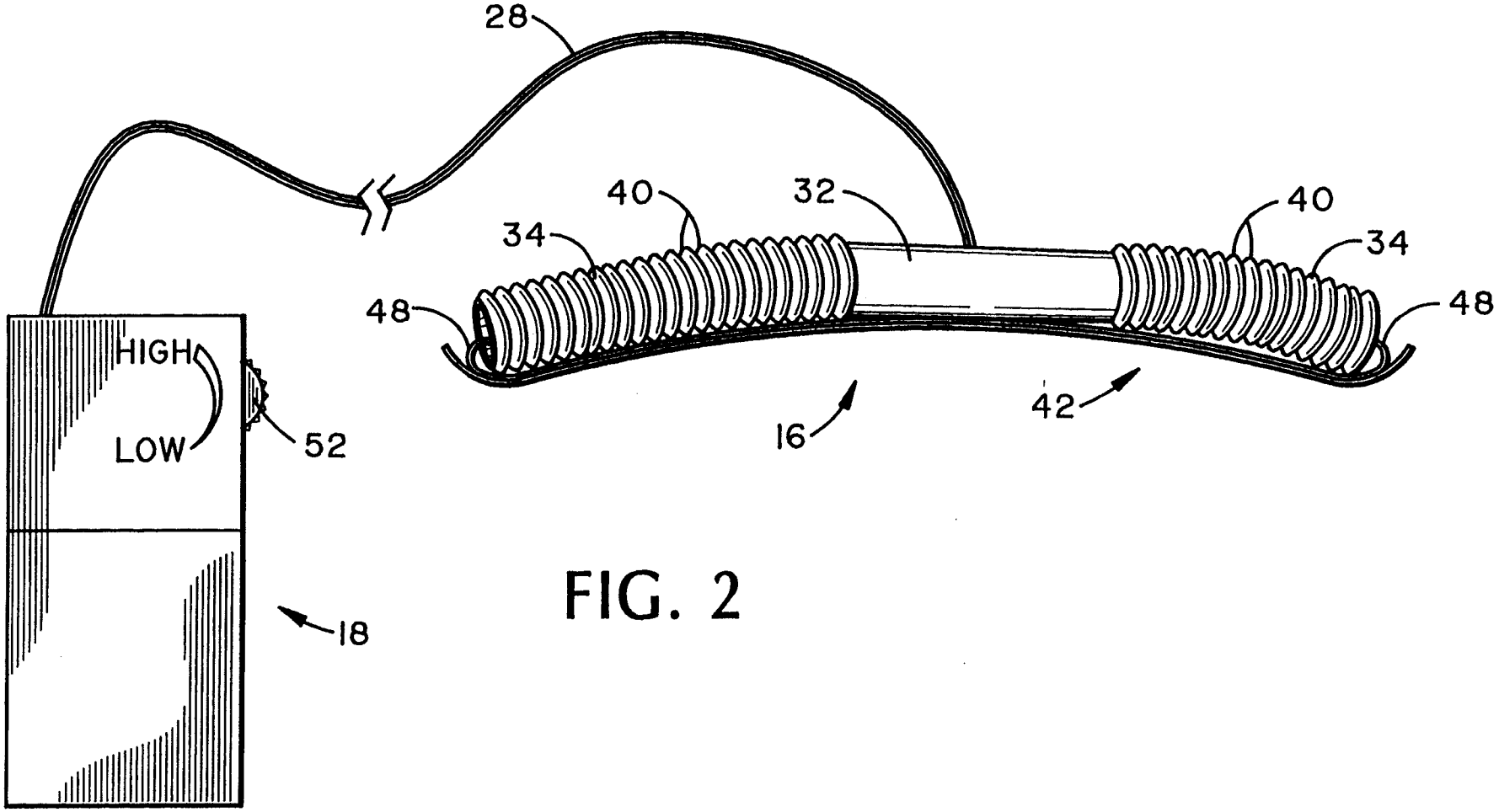
FIG. 2 is a front elevational view of a vibrating mechanism component and a control module of the vibrating neck rest of FIG. 1.
Figure 3:
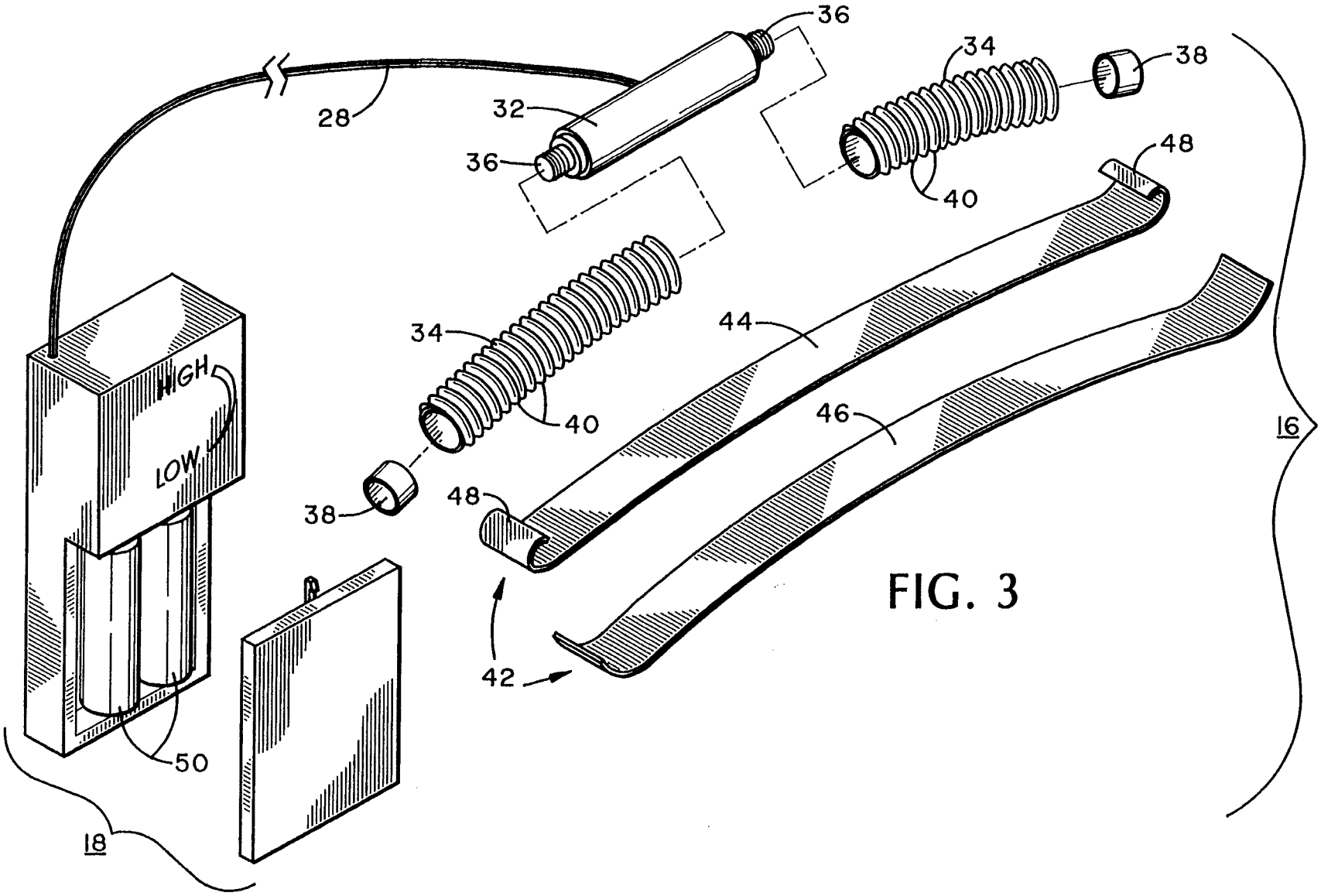
FIG. 3 is an exploded perspective view of the vibrating mechanism component and the control module of FIG. 2.

Referring now most particularly to FIGS. 2 and 3, the vibrating mechanism 16 generally includes a centrally located vibration unit 32, which is preferably of generally elongated cylindrical shape, a pair of tubes 34 that extend outward, one from each end of the centrally located vibration unit 32, the tubes 34 connecting to the centrally located vibration unit 32 by surrounding a pair of cylindrical studs 36 that extend from the opposing end faces thereof, and a pair of hammers 38, one each of the hammers 38 being disposed within one each of the distal ends of the tubes 34. The tubes 34 are preferably formed from a plastic material and are each preferably provided with a series of external surface corrugations or ribs 40. The hammers 38 are preferably constructed of a heavier material (e.g., a metal such as steel) as compared to the tubes 34 and are preferably annular shaped, as is most clearly seen in FIG. 3.

The vibrating mechanism 16 additionally includes a shield 42 that preferably overlays at least a portion of the forward facing surfaces of the vibrating mechanism 16. The shield 42 prevents the somewhat sharp contours of the vibrating mechanism 16 from causing discomfort to the user, and additionally serves to better distribute the vibrating action over an extended surface of the cushion 12. As is seen most clearly in FIG. 3, the shield 42 preferably includes two separate and discrete shield members: a first shield member 44 and a second shield member 46, with the first shield member 44 being located intermediate between the vibration unit 32 and the second shield member 46. Preferably the shield 42 extends over the length of the vibration unit 32, the tubes 34, and the hammers 38. Most preferably, as is seen in FIGS. 2 and 3, the first shield member 44 is provided with a pair of inwardly turned ends 48 that project into the annular shaped hammers 38, this preferred construction acting to better distribute the vibrating motion more evenly over the arcuate forward surface 20 of the cushion 12.

The control module 18 is preferably powered by a pair of compact storage batteries 50 and includes at least a speed control 52 which allows the user to adjust the speed and/or intensity of the vibration produced. Preferably, the speed control 52 additionally allows the user to completely deactivate the vibrating mechanism 16.

While the invention has been herein described by way of a particular preferred embodiment, various substitutions of equivalents may be effected without departing from the spirit and scope of the invention as set forth in the following claims.

What is claimed is:

1. A vibrating neck rest particularly adapted for attachment to and use in conjunction with a passenger seat of a motor vehicle, said vibrating neck rest comprising:

cushion;

said cushion being substantially elongated and having a major longitudinal axis;

said cushion having a front surface for contacting the neck of a user;

a vibration unit disposed within said cushion for producing a vibration on at least said front surface of said cushion;

a pair of tubes, one each of said pair of tubes extending outward from an opposing side of said vibration unit;

each of said tubes being provided with annular corrugations on at least a portion of its external surface;

said pair of tubes extending outward from said vibration unit substantially parallel to said major longitudinal axis of said cushion;

a pair of hammer members;

each of said pair of hammer members being annular shaped, and one each of said pair of hammer members being disposed within one each of a distal end of said pair of tubes;

a shield apparatus extending over at least a portion of said front surface of said cushion, said shield apparatus overlaying said vibration unit, said pair of tubes, and said pair of annular hammer members;

said shield apparatus comprising a first shield member and a distinct and separate second shield member, said first shield member being disposed intermediate between said vibration unit and said second shield member;

said first shield member being provided with a pair of inwardly turned ends, one each of said inwardly turned ends projecting into one each of said annular shaped hammer members;

attachment means for attaching said cushion to the passenger seat of the motor vehicle; and a control mechanism for altering at least one characteristic of said vibration produced by said vibration unit;

said control mechanism being movable to a point remote from said cushion;

said control mechanism comprising battery powered control circuitry; and said characteristic of said vibration altered by said control mechanism comprising a speed of vibration.

2. A vibrating neck rest particularly adapted for attachment to and use in conjunction with a passenger seat of a motor vehicle, comprising:

a substantially elongated cushion having a major longitudinal axis and a front surface for contacting the neck of a user;

vibrating means disposed within said cushion for producing a vibration on at least a portion of a surface of said cushion, said vibrating means comprising:

a vibration unit;

a pair of tubes provided with annular corrugations on at least a portion of their respective external surfaces, one each of said pair of tubes extending outward from an opposing side of said vibration unit and being substantially parallel to said major longitudinal axis of said cushion; and a pair of annular shaped hammer members, one each of said hammer members being attached to a distal end of one each of said pair of tubes, and one each of said pair of hammer members being disposed within one each of said distal ends of said pair of tubes;

attachment means for attaching said cushion to the passenger seat of the motor vehicle;

a control mechanism for altering at least one characteristic of said vibration produced by said vibrating means, said control mechanism being movable to a point remote from said cushion; and a shield apparatus extending over at least a portion of said front surface of said cushion, said shield apparatus overlaying at least said vibration unit and said pair of tubes, said shield apparatus further comprising:

a first shield member and a distinct and separate second shield member, said first shield member being disposed intermediate between said vibration unit and said second shield member;

said first shield member being provided with a pair of inwardly turned ends, one each of said inwardly turned ends projecting into one each of said annular shaped hammer members.

3. A vibrating neck rest particularly adapted for attachment to and use in conjunction with a passenger seat of a motor vehicle, comprising:

a substantially elongated cushion having a major longitudinal axis and a front surface for contacting the neck of a user;

vibrating means disposed within said cushion for producing a vibration on at least a portion of a surface of said cushion, said vibrating means comprising:

a vibration unit;

a pair of tubes provided with annular corrugations on at least a portion of their respective external surfaces, one each of said pair of tubes extending outward from an opposing side of said vibration unit and being substantially parallel to said major longitudinal axis of said cushion; and a pair of annular shaped hammer members, one each of said hammer members being attached to a distal end of one each of said pair of tubes, and one each of said pair of hammer members being disposed within one each of said distal ends of said pair of tubes:

attachment means for attaching said cushion to the passenger seat of the motor vehicle;

a control mechanism, comprising battery powered control circuitry, for altering at least one characteristic of said vibration produced by said vibrating means, said control mechanism being movable to a point remote from said cushion; and a shield apparatus extending over at least a portion of said front surface of said cushion, said shield apparatus overlaying at least said vibration unit and said pair of tubes, said shield apparatus further comprising:

a first shield member and a distinct and separate second shield member, said first shield member being disposed intermediate between said vibration unit and said second shield member;

said first shield member being provided with a pair of inwardly turned ends, one each of said inwardly turned ends projecting into one each of said annular shaped hammer members.

4. A vibrating neck rest according to claim 3, wherein said characteristic of said vibration altered by said control mechanism comprises a speed of vibration.

* * * * *